United States Patent [19]

Nauta

[11] 3,985,262

[45] Oct. 12, 1976

[54] VESSEL PROVIDED WITH A RECESSED LOCKING LID

[75] Inventor: Constant Johan Nauta, Overveen, Netherlands

[73] Assignee: Nautamix Patent A.G., Zug, Switzerland

[22] Filed: Oct. 7, 1975

[21] Appl. No.: 620,429

[30] Foreign Application Priority Data

Oct. 11, 1974 Netherlands ..... 7413443

[52] U.S. Cl. ..... 220/349; 222/509; 222/559

[51] Int. Cl.[2] ..... B65D 43/20

[58] Field of Search ..... 220/345, 346, 349; 222/509, 559, 561

[56] References Cited

UNITED STATES PATENTS

| | | | |
|---|---|---|---|
| 3,744,684 | 7/1973 | Heimgartner | 222/509 |
| 3,883,049 | 5/1975 | McCarthy et al. | 222/559 |

*Primary Examiner*—George T. Hall
*Attorney, Agent, or Firm*—Fleit & Jacobson

[57] ABSTRACT

An actuating mechanism for a locking lid, capable of completely clearing an opening in a vessel and which, in the closed position, is flush with the inner wall of the vessel. The actuating mechanism comprises a sleeve which slides over a fixed rod at an angle of between 0° - 30° with the vessel wall. The sleeve carries at spaced points two pivotally mounted, parallel links of equal length which are pivotally connected to the lid. The lid also carries a guide wheel running in a guide track disposed perpendicular to the vessel wall and one pivotal connection between the sleeve and link carries a connecting rod displaced by a crank provided with an actuating lever. In the initial opening and final closing movements, the locking lid moves perpendicular to the wall guided by the guide wheel running in the guide track and after clearing the opening, the lid moves parallel to itself and is brought back in front of the opening.

6 Claims, 4 Drawing Figures

VESSEL PROVIDED WITH A RECESSED LOCKING LID

BACKGROUND AND SUMMARY OF THE INVENTION

The invention relates to a vessel with a locking lid recessed in its wall, and a mechanism for moving the lid. The vessel comprises a mobile supporting member with a connecting element for the lid. Vessels with lids are known in various versions. Larger lids, however, sometimes require a complicated and moreover, extensive mechanism which may be disadvantageous.

These complications in the known vessels occur because the lid is recessed in the wall of the vessel, so that a pivot cannot possibly be utilized. In order to ensure a liquidproof or gastight sealing along the edge of the lid sometimes additional means are required.

This invention provides a mechanism for moving the locking lid. The mechanism is constructed from rather simple parts and yet ensures an efficient locking and opening. The connecting element between the supporting member and the lid consists of some rods, which are pivotally connected both with the lid and with the supporting member. When the lid is locked the pivotal points of the rods substantially coincide with the angular points of a rectangle. In such a mechanism the supporting member need only be moved along the wall of the vessel and at a slight distance therefrom whereby the lid will then move in a transverse direction relative to the wall of the vessel. In the locked position a toggle joint effect will be produced in the rods, whereby the lid can be strenuously pressed in place.

The mechanism can be constructed in various ways. A correct transverse movement of the lid can be obtained in a construction in which the rods are mutually parallel and have an identical length, while the supporting member is movable in a direction forming an angle, ranging from 0° to 30°, with the wall of the vessel. Thus a kind of parallelogram structure is obtained whereby the lid is lifted without any tilting or turning movement, or pressed down again.

Sometimes it is desirable to displace the lid not only in a transverse direction but subsequently also in a direction longitudinal to the wall of the vessel. This is particularly of importance when the lid is accommodated in the lower wall or bottom of a vessel. Under these circumstances the lid may form a barrier for the material flowing from the cleared opening. The present invention provides also a solution to the situation that occurs when the pivotal points between the rods and the lid only allow a limited angular displacement so that after reaching the maximum deflection resulting from displacement of the supporting member, a further movement of this member results in a movement of the lid in a direction parallel to the wall.

The transverse movement of the lid can be limited to a distance corresponding to the wall thickness of the vessel, whereupon the lid moves laterally along the wall. In case of a circular lid, a crescent shaped outlet is first formed, which finally becomes a completely circular hole. Thus this construction may accomplish a metering effect since it is a simple expedient to adjust the width of the outlet to accomplish a predetermined flow rate. The side of the lid turned to the interior of the vessel is scraped clean during the movement along the wall, which may be of importance in the case of a product tending to stick thereto.

The supporting member can be driven by motor but also manually, the latter manner being simpler and less expensive.

DETAILED DESCRIPTION OF THE INVENTION

The invention is hereinafter described with reference to the accompanying drawings, showing two embodiments of the vessel with a recessed lid and a displacement mechanism.

Figure 1:
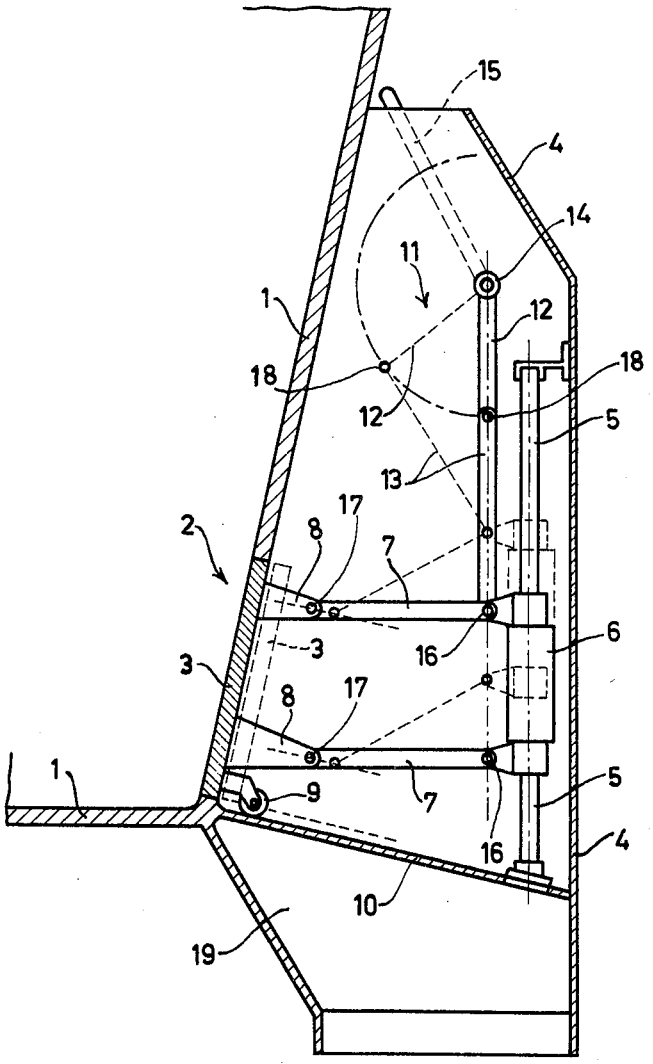
FIG. 1 shows the lateral wall of part of a conical vessel provided with a locking lid.

Only a small part of a vessel 1 is shown in the drawing. This vessel can form part of a mixer within which mixing members (not shown) are mounted serving to bring the material within the vessel into a particular condition or composition. For the periodical discharge of the contents of the vessel 1 an outlet 2 is provided in the wall. This outlet can be closed by a recessed locking lid 3. This lid is shown in FIG. 1 in the locked position. The open position is represented by dotted lines. On the outside of vessel 1 a casing 4 is disposed at the location of the outlet 2. Within this casing some profiled rods, or guide rods, 5 are mounted. A supporting member 6 is designed to move along these rods. This member is interconnected with lid 3 by means of rods 7, pivotally connected at their ends. The mounting of rods 7 to the lid 3 is effected by means of lugs 8 which have a different height such that an imaginary connecting line between the pivotal points 17 with the rods 7 is parallel to the centreline of the profiled rods 5. When lid 3 is locked, rods 7 are substantially perpendicular to guide rods 5. An abutment, or roller 9, which can slide along a guide strip 10 is disposed on the lid 3. The sliding movement of the supporting member 6 along the rods 5 is obtained by means of a crank mechanism 11 consisting of a crank arm 12 and a driving rod 13 pivotally connected therewith. This driving rod is pivoted to supporting member 6. Arm 12 turns on a shaft 14 one end of which protrudes from casing 4. A lever 15 which can be swung by hand through an angle of about 180° is secured to that end. It is obvious that when arm 12 is rotated, supporting member 6 slides and the lid 3 is moved in a transverse direction relative to the wall of the vessel 1. The rods 7 which have an equal length form part of a parallelogram structure, the angular points of which are formed by pivotal points 16 with member 6 and the pivotal points 17 with lid 3. When lid 3 is in locked position considerable locking force can be maintained, while yet little force need be exerted on lever 15. This is due to the twice produced toggle joint effect. This effect is namely produced in pivotal points 17 at a point when the rods 7 are perpendicular to the wall of vessel 1, while simultaneously an analogous effect is produced in pivotal point 18 between arm 12 and driving rod 13. When the lid 3 is locked pivotal point 18 is located on the connecting line between shaft 14 and pivotal point 16. In opened position of lid 3 (represented in dotted lines) the contents of the vessel 1 will be capable of flowing, via outlet 2 and chute 19 at the lower most end of case 4, into a receptacle situated thereunder.

Figure 2:
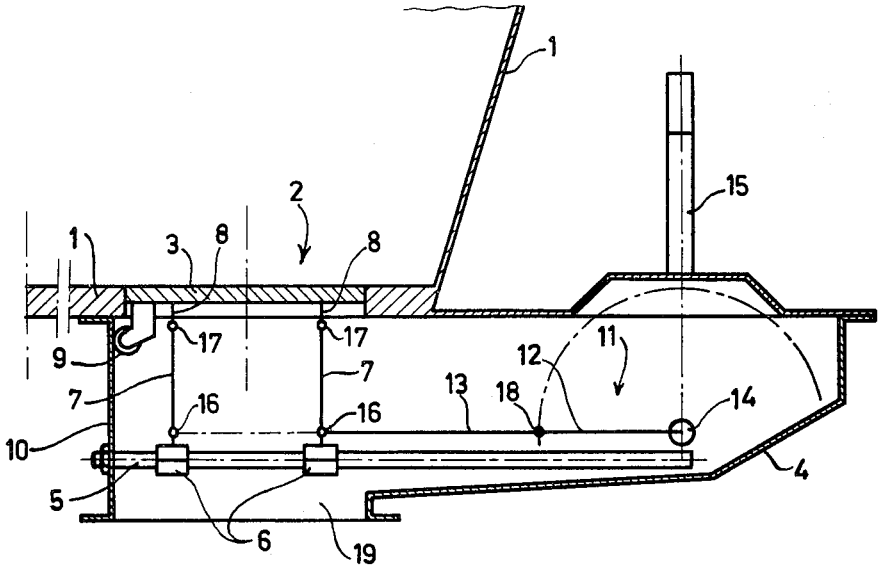
FIGS. 2 and 3 show a modification in which the lid is accommodated in the lower wall or bottom of a conical vessel.
Figure 3:
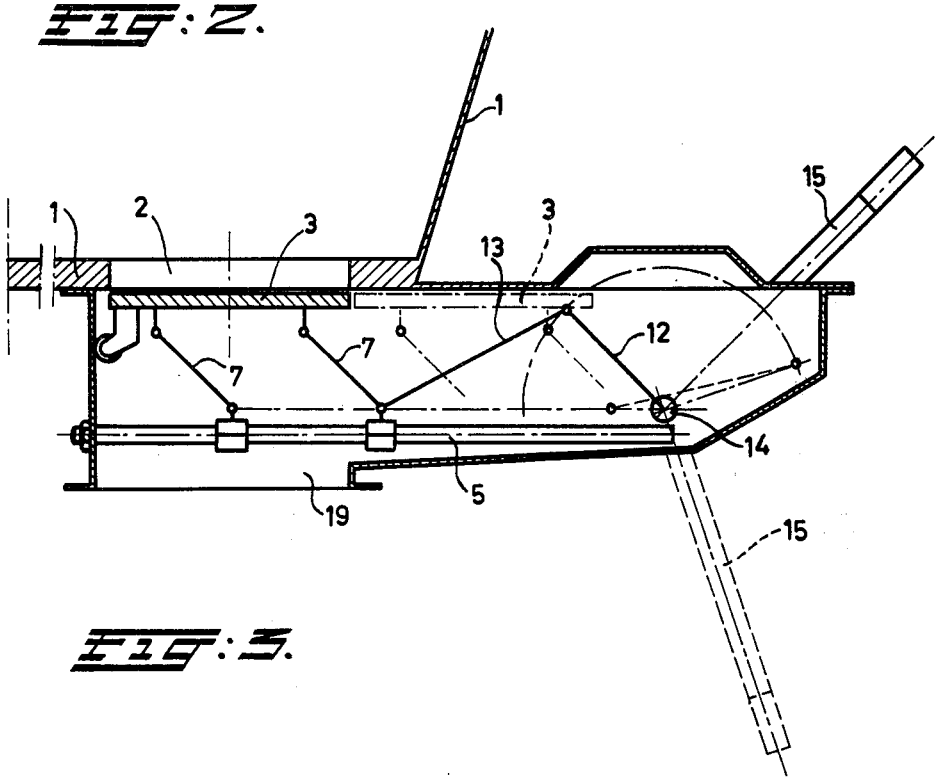
Figure 4:
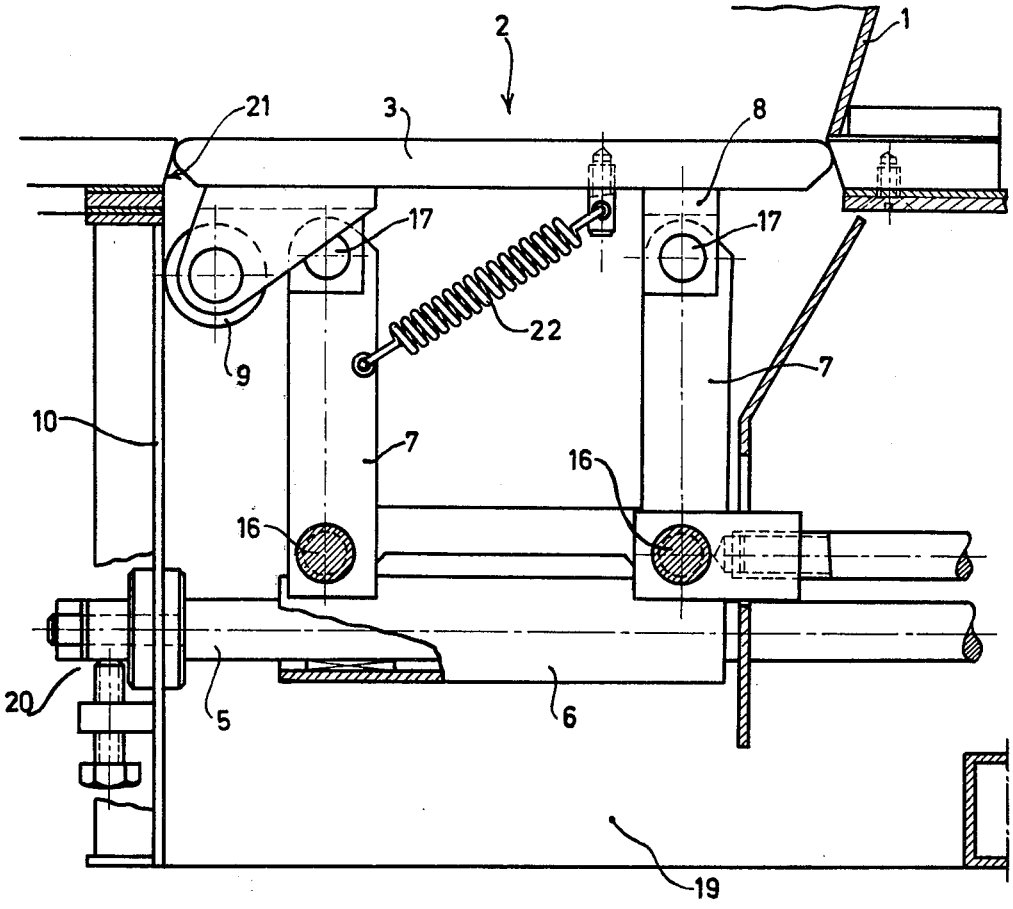
FIG. 4 shows to a larger scale part of the embodiment according to FIG. 2.

The embodiment according to FIGS. 2 and 3 differs, only from the one as shown in FIG. 1 by the fact that lid 3 is accommodated in the lower wall or bottom of vessel 1 so that it can be opened by means of the force of gravity. The profiled rods 5 are located parallel to the lower wall of vessel 1, so that the fastening lugs 8 of the lid 3 may have an equal length. A further important detail of the modification according to FIG. 2 is shown in FIG. 4 and consists in that the pivotal points 17 between rods 7 and lid 3 only allow a limited angular displacement (in this case some 45°). This results in that after attaining the maximal deflection as a consequence of the lateral movement of supporting member 6, a further movement of this member results into a displacement of the lid parallel to the wall of the vessel. This situation is represented in dotted lines in FIG. 3. Due to a more or less lateral displacement of lid 3 the outlet 2 can be cleared to a greater or lesser degree. Abutment 9 will slide in the last closing phase and in the first opening phase, along guide 10 which is disposed perpendicular to the wall of the vessel 1.

FIG. 4 also shows that the position of each profiled rod 5 along which supporting member 6 is guided, is adjustable by means of a provision 20. Lid 3 cooperates with a conical edge 21 along the circumference of outlet 2. Finally it should be noted that under certain circumstances it is desirable to dispose a spring between lid 3 and one or more rods 7, the spring serving to compensate the disturbing effect of the force of gravity, particularly at an inclined position of the lid. In FIG. 4 a draw spring 22 is shown, which ensures that roller 9 is kept in contact with the guide 10.

What we claim is:

1. A vessel having a closable opening in a wall therein, a locking lid recessed in said wall of said vessel, a mobile supporting member for moving the locking lid so as to open and close said opening, a connecting element comprising at least two rods, one end of each of said rods pivotally connected to the locking lid, the other end of each of said rods pivotally connected to said mobile supporting member, whereby when the lid is in a locked position the pivotal points of the rods substantially coincide with the points of a rectangle.

2. A vessel according to claim 1, wherein the rods are mutually parallel and have an equal length while the supporting member is movable in a direction forming an angle, ranging from 0° to 30°, with the wall of the vessel.

3. A vessel according to claim 1, wherein an abutment is fixed to the lid, which in the last closing phase and in the first opening phase of the lid, the abutment can slide along a guide which is substantially perpendicular to the wall of the vessel.

4. A vessel according to claim 2, wherein the pivotal points between the rods and the lid only allow a limited angular displacement, so that after reaching the maximal deflection owing to a displacement of the supporting member, a further movement of this member results in a movement of the lid in a direction parallel to the wall of the vessel.

5. A vessel according to claim 1, wherein the supporting member is guided along at least one profiled rod, and further including a crank means for moving the supporting member.

6. A vessel according to claim 5, wherein the position of said profiled rod is adjustable.

* * * * *